US006981812B1

(12) United States Patent
Hsieh

(10) Patent No.: US 6,981,812 B1
(45) Date of Patent: Jan. 3, 2006

(54) OPENING AND CLOSING DEVICE FOR CAPLESS RETRACTABLE MARKER PEN

(75) Inventor: Yung-Chieh Hsieh, Dali (TW)

(73) Assignee: Flonto Corp., Taipei (TW)

( * ) Notice: Subject to any disclaimer, the term of this patent is extended or adjusted under 35 U.S.C. 154(b) by 0 days.

(21) Appl. No.: 11/177,433

(22) Filed: Jul. 11, 2005

(30) Foreign Application Priority Data

Feb. 24, 2005 (TW) ..... 94105692 A

(51) Int. Cl.
*B43K 24/02* (2006.01)
*B43K 5/16* (2006.01)

(52) U.S. Cl. ..... 401/108; 401/107; 401/99

(58) Field of Classification Search ..... 401/108, 401/107, 99, 115, 117, 110, 111
See application file for complete search history.

(56) References Cited

U.S. PATENT DOCUMENTS 3,292,593 A * 12/1966 Tetsuo ..... 401/107
3,362,778 A * 1/1968 Angelo ..... 401/107
3,427,112 A * 2/1969 Ishii et al. ..... 401/107
3,525,573 A * 8/1970 Fend ..... 401/108
4,540,300 A * 9/1985 Midorikawa ..... 401/107
4,560,298 A * 12/1985 Oki et al. ..... 401/107
4,969,764 A * 11/1990 Gregory ..... 401/108
5,915,867 A * 6/1999 Hashimoto ..... 401/108
6,866,436 B2 * 3/2005 Kanari et al. ..... 401/108
2005/0084320 A1 * 4/2005 Carroll ..... 401/108
2005/0191112 A1 * 9/2005 Yoon ..... 401/108

* cited by examiner

*Primary Examiner*—Khoa D. Huynh
(74) *Attorney, Agent, or Firm*—Rosenberg, Klein & Lee

(57) ABSTRACT

An opening and closing device for a capless retractable marker pen is disclosed. The opening and closing device is based on a two-stage design for achieving the purpose of protracting and retracting a writing tip. The opening and closing device for the capless retractable marker pen of the present invention is manufactured easily and assembled conveniently, so as to greatly increase the processing speed and yield.

13 Claims, 8 Drawing Sheets

OPENING AND CLOSING DEVICE FOR CAPLESS RETRACTABLE MARKER PEN

RELATED APPLICATIONS

The present application is based on, and claims priority from, Taiwan Application Serial Number 94105692, filed Feb. 24, 2005, the disclosure of which is hereby incorporated by reference herein in its entirety.

FIELD OF THE INVENTION

The present invention relates to an opening and closing device for a capless retractable marker pen, and more particularly, to an opening and closing device based on a two-stage design for a capless retractable marker pen.

BACKGROUND OF THE INVENTION

According to different inks used, ordinary marker pens can roughly be categorized as water-based marker pens and oil-based marker pens. In order to prevent a writing tip from becoming dried out and thus unusable from long-term exposure to air, an outer cap is usually used to seal the writing tip of the marker pen. However, two hands are required to uncap and cap a marker pen with the outer cap, which is very inconvenient. Furthermore, when capping or uncapping the writing tip, the outer cap can be easily lost along with any hope of preventing the writing tip from drying out. In order to resolve these issues related to using the outer cap, a capless retractable marker pen has been developed. Typically, the cover of the capless retractable marker pen is hidden within the pen tube, and the protracting and retracting of the writing tip is controlled by an actuating means installed in the top of the pen tube. Therefore, compared with the marker pen with an outer cap, the capless retractable marker pen has a superior competitive advantage on the market.

FIG. 1 illustrates a partial cross section showing a conventional capless retractable marker pen. The conventional capless retractable marker pen 100 comprises a pen tube 110, a sheath 120, a writing member 130 and an opening and closing device 140. The pen tube 110 has an upper opening (not shown) and a lower opening 113, in which an arc protrusion 115 is set within the pen tube 110, and is parallel to the lower opening 113 and set apart from the lower opening 113 by a distance L. The sheath 120 is installed within the pen tube 110 and has an upper portion 121 and a lower portion 123, in which a diameter D of the upper portion 121 is greater than a diameter d of the lower portion 123. The top of the upper portion 121 is a closed end (not shown), and the bottom of the lower portion 123 is an open end 127. Typically, the writing member 130 is coaxially disposed within the sheath 120 and has an upper portion 131 and a lower portion 133. The upper portion 131 of the writing member 130 is disposed within the upper portion 121 of the sheath 120 for absorbing and storing ink. The lower portion 133 of the writing member 130 is disposed within the lower portion 123 of the sheath 120, in which a portion of the lower portion 133 extends into the upper portion 121. The lower portion 133 of the writing member 130 extends out of the open end 127 in the lower portion 123 of the sheath 120 to expose a writing tip 135. The ink is transported from the upper portion 131 to the writing tip 135 through the lower portion 133 by capillarity.

In the conventional capless retractable marker pen designs, various opening and closing devices are used to replace the outer cap for achieving the purpose of protracting and retracting a writing tip. For example, the opening and closing device 140 comprises a supporting device 141, a sealing member 161, a plastic filament 169 and a spring member 170. Referring to FIG. 2, which is a three-dimensional diagram of a conventional opening and closing device, the supporting device 141 is installed outside the lower portion 123 of the sheath 120. The supporting device 141 has an upper opening 143 and a lower opening 145, and a sidewall 147 of the supporting device 141 is set with two opposite grooves 149 extending from the upper opening 143. The sealing member 161 covers the writing tip (not shown) and includes a cover plate 163 and a cover supporting tube 165, and a side 164 of the cover plate 163 is movably deposed on a side 166 of the cover supporting tube 165. A sidewall of the cover supporting tube 165 is set with two opposite channels 167. The plastic filament 169 passes and is deposed in the grooves 149 of the supporting device 141, the cover plate 163 and the channels 167, and is clipped into the channels 167. A spring 170 is coaxially deposed outside the lower portion 123 of the sheath 120 and within the supporting device 141. The spring 170 shores the supporting device 141 and the cover supporting tube 165 by elastic force and tightly buckles the supporting device 141 and the sealing member 161 by the plastic filament 169, so as to make the cover plate 163 cover a lower surface 168 of the cover supporting tube 165 to seal the writing tip (not shown).

FIG. 3(A) illustrates an opening action of a cover plate of an opening and closing device of a conventional capless retractable marker pen. When the sheath 120 and the writing tip 135 are moved downward by using an actuating means (not shown) installed on the top of the sheath 120, the opening and closing device 140 descends to the arc protrusion 115 in the pen tube 110 along the direction shown by an arrow 171, and the sealing member 161 continuously rises along the direction shown by the arrow 171 to make the plastic filament 169 loosened gradually. The cover plate 163 is opened resulting from the loosening of the plastic filament 169, so as to make the writing tip 135 project from the cover supporting tube 165 for writing.

FIG. 3(B) illustrates a closing action of a cover plate of an opening and closing device of a conventional capless retractable marker pen. After writing, the sheath 120 and the writing tip 135 are moved upwardly by using the actuating means (not shown), the supporting device 141 continuously rises along the direction shown by an arrow 173, and the sealing member 161 descends relatively to make the plastic filament 169 tighten gradually, so that the lower surface 168 of the cover supporting tube 165 is covered by the cover plate 163 to seal the writing tip 135. In brief, the opening and closing device for the conventional capless retractable marker pen is based on a two-stage design, which combines the supporting device 141, the sealing member 161, the plastic filament 169 and the spring 170, for achieving the purpose of protracting and retracting the writing tip.

The examples that use any of the various opening and closing devices, such as the disclosure in Taiwan patent No. 341,920, the disclosure in U.S. Pat. No. 4,969,764 and the disclosure in U.S. Pat. No. 4,560,298, are hereby incorporated by reference herein in their entirety.

However, the conventional capless retractable marker pens still have many problems requiring solving. The assembling of the opening and closing device of the conventional capless retractable marker pens is done by hand to put the plastic filament 169 on the grooves 149 of the supporting device 141, the cover plate 163 and the channels 167, so that the assembling process is complicated, time-consuming, and the difficult to be sped up in mass production. Furthermore, the opening and closing effect of the opening and closing device is degraded by the elastic fatigue of the plastic filament 169 after being used for a period of time.

It would therefore be desirable for the designers, the users and the manufacturers of pens to improve the structure of the conventional opening and closing device to simplify the manufacture and assembly and thereby increase the manufacturing speed and the yield.

SUMMARY OF THE INVENTION

One objective of the present invention is to provide an opening and closing device for a capless retractable marker pen, which is based on a two-stage design for achieving the purpose of protracting and retracting a writing tip. The opening and closing device for the capless retractable marker pen of the present invention allows for easy manufacture and convenient assembly, so that an automation process can be used to greatly increase the processing speed and yield.

According to the aforementioned objectives, the present invention provides an opening and closing device for a capless retractable marker pen, comprising a supporting device, a cover holder, a sealing member and a spring member. The supporting device has an upper opening and a lower opening, wherein a plurality of hooks are disposed around the lower opening, and a protrusion is deposed in a substantially central portion of an outer surface of each hook. The cover holder has an upper ring, a plurality of supports connected to the upper ring and a lower ring connected to the supports, wherein the upper ring is coaxially disposed outside the supporting device and clipped between a rear end of each hook and each protrusion. The sealing member is coaxially clipped within the lower ring of the cover holder and covers a writing tip disposed in the supporting device and the cover holder, wherein the sealing member includes a cover plate and a cover supporting tube, and a side of the cover plate is movably deposed on a side of the lower ring. The spring member is coaxially disposed within the supporting device, wherein the spring member shores the supporting device and the cover supporting tube by elastic force, so as to make the cover plate cover a lower surface of the cover supporting tube to seal the writing tip. When the writing tip moves downward, the opening and closing device descends to an arc protrusion in the pen tube, and the cover holder continuously rises across the protrusions of the supporting device to reach the outside of the upper opening of the supporting device, wherein with the rise of the cover holder, the cover plate is opened to make the writing tip project from the cover supporting tube.

According to a preferred embodiment of the present invention, the supporting device and the cover holder may be composed of the same thermoplastic material or different thermoplastic materials.

According to the aforementioned objectives, the present invention further provides a capless retractable marker pen comprising a pen tube, a sheath, a writing member and an opening and closing device. The pen tube has a first upper opening and a first lower opening, wherein an arc protrusion is set within the pen tube, is parallel to the first lower opening and is set apart from the first lower opening by a distance. The sheath has a first upper portion and a first lower portion, wherein a diameter of the first upper portion is greater than a diameter of the first lower portion. The writing member is coaxially disposed within the sheath and has a second upper portion and a second lower portion, wherein the second upper portion is disposed within the first upper portion for storing ink, the second lower portion is disposed within the first lower portion to expose a writing tip, and a diameter of the second lower portion is smaller than a diameter of the second upper portion. The opening and closing device comprises a supporting device, a cover holder, a sealing member and a spring member. The supporting device is coaxially disposed outside the first lower portion of the sheath and has a second upper opening and a second lower opening, wherein a plurality of hooks are disposed around the second lower opening, and a protrusion is deposed in a substantially central portion of an outer surface of each hook. The cover holder has an upper ring, a plurality of supports connected to the upper ring, and a lower ring connected to the supports, wherein the upper ring is coaxially disposed outside the supporting device and clipped between a rear end of each hook and each protrusion. The sealing member is coaxially clipped within the lower ring and covers the writing tip, wherein the sealing member includes a cover plate and a cover supporting tube, and a side of the cover plate is movably deposed on a side of the lower ring. The spring member is coaxially disposed outside the first lower portion of the sheath and within the supporting device, wherein the spring member shores the supporting device and the cover supporting tube by elastic force, so as to make the cover plate cover a lower surface of the cover supporting tube to seal the writing tip. When the sheath moves downward, the opening and closing device descends to the arc protrusion in the pen tube, and the cover holder continuously rises across the protrusions of the supporting device to reach the outside of the second upper opening of the supporting device, wherein with the rise of the cover holder, the cover plate is opened to make the writing tip project from the cover supporting tube.

According to a preferred embodiment of the present invention, the ink may be, for example, water-based ink or oil-based ink.

In the application of the opening and closing device for the capless retractable marker pen, the opening and closing device is based on a two-stage design for achieving the purpose of protracting and retracting a writing tip, and allows for easy manufacture and convenient assembly, so that an automation process can be used to greatly increase the process speed and yield.

BRIEF DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION OF THE PREFERRED EMBODIMENT

The opening and closing device for a capless retractable marker pen of the present invention is based on a two-stage design for achieving the purpose of protracting and retracting a writing tip. In order to make the illustration of the present invention more explicit and complete, the following description is stated with reference to FIGS. 4 through 6(B)

Figure 1:
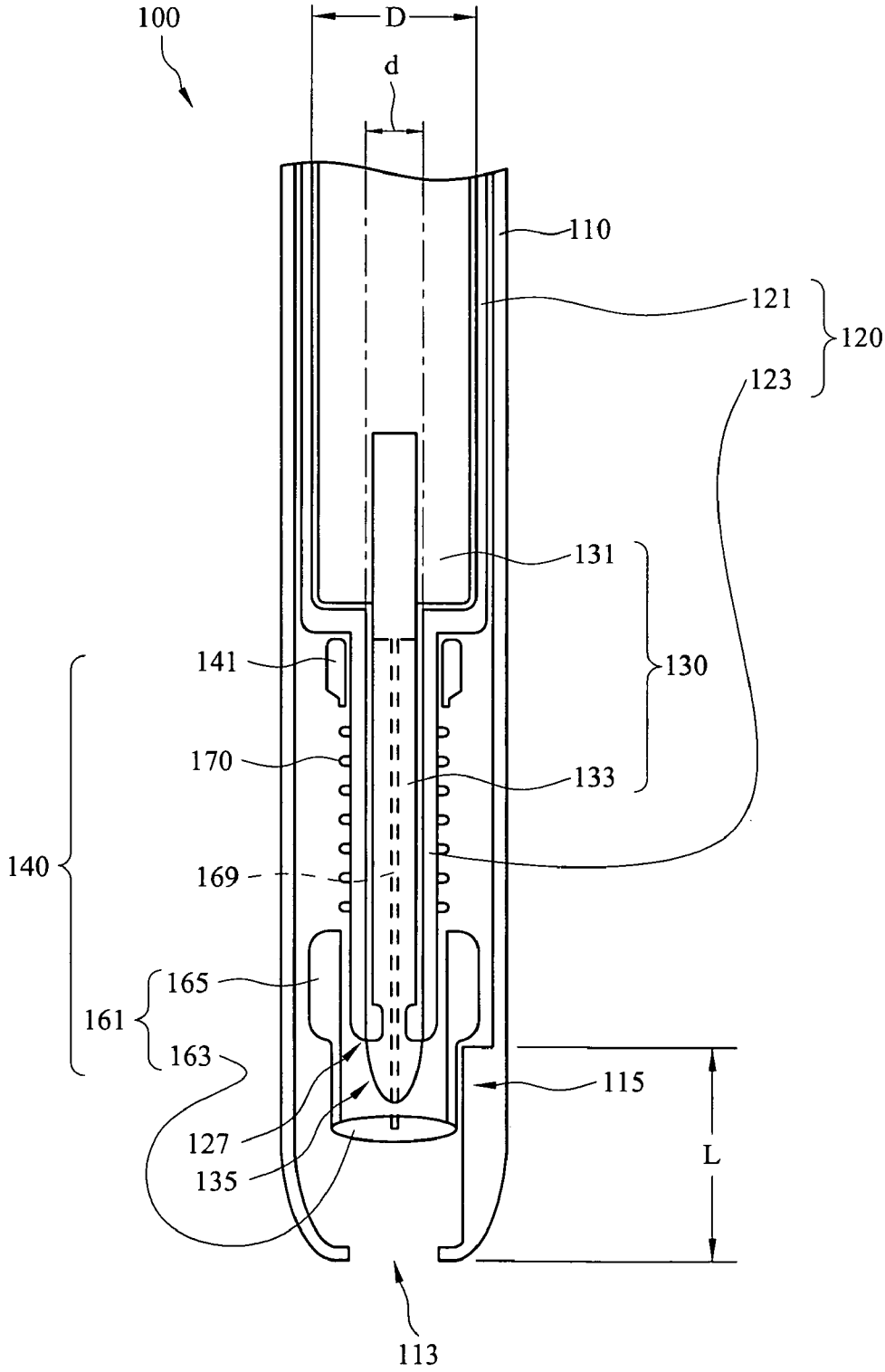
FIG. 1 (PRIOR ART)
FIG. 1 illustrates a partial cross section showing a conventional capless retractable marker pen.
Figure 2:
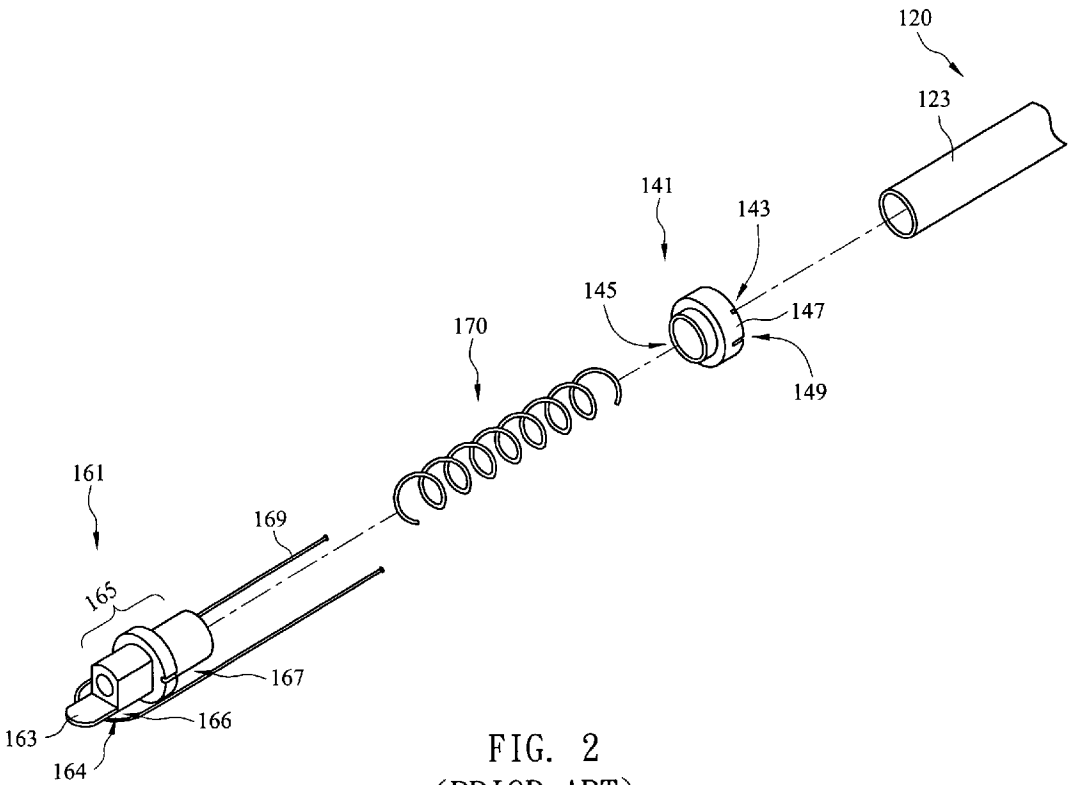
FIG. 2 (PRIOR ART)
FIG. 2 illustrates a three-dimensional diagram of a conventional opening and closing device.
Figure 3A:
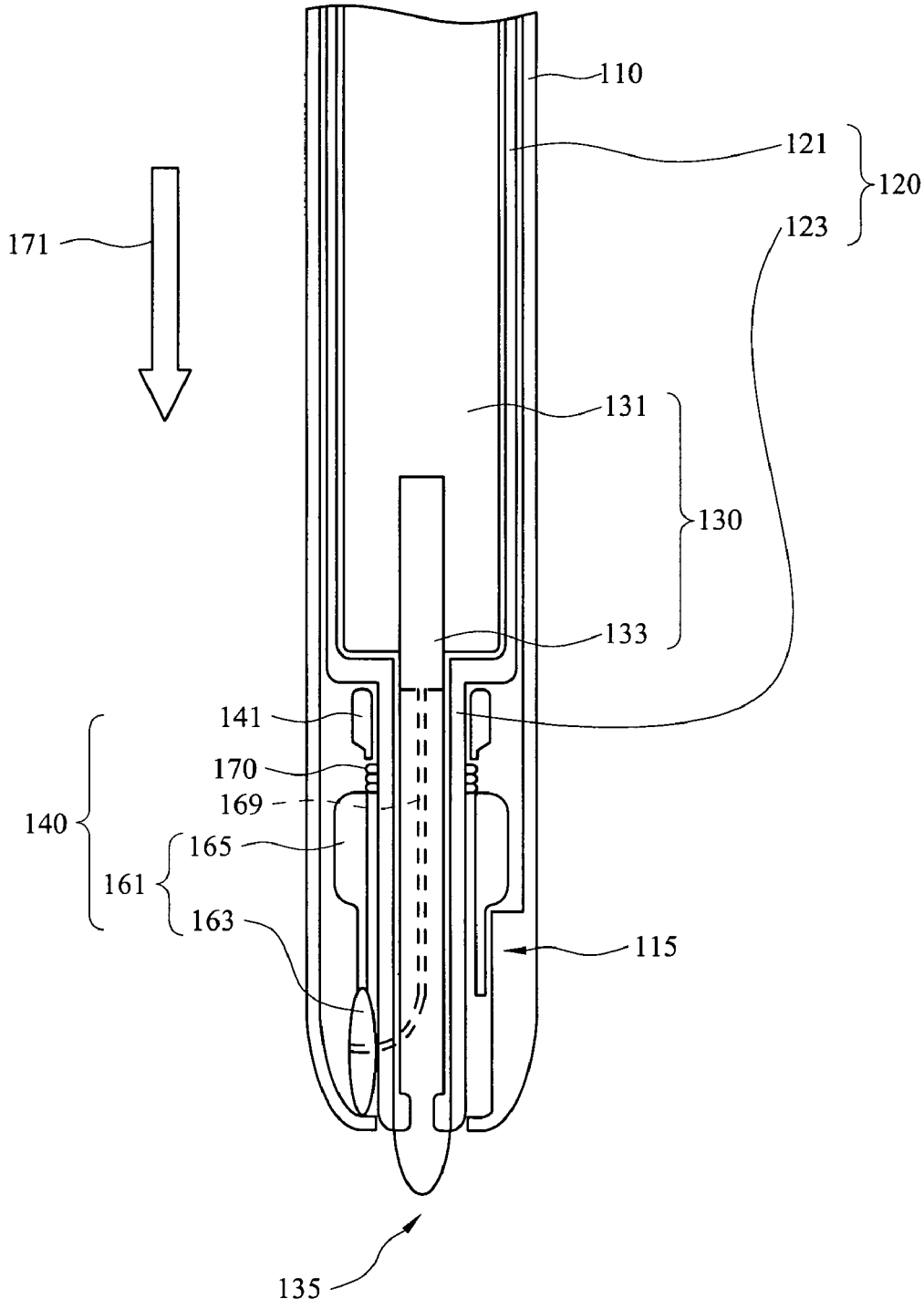
FIG. 3(A) (PRIOR ART)
FIG. 3(A) illustrates an opening action of a cover plate of an opening and closing device of a conventional capless retractable marker pen.
Figure 3B:
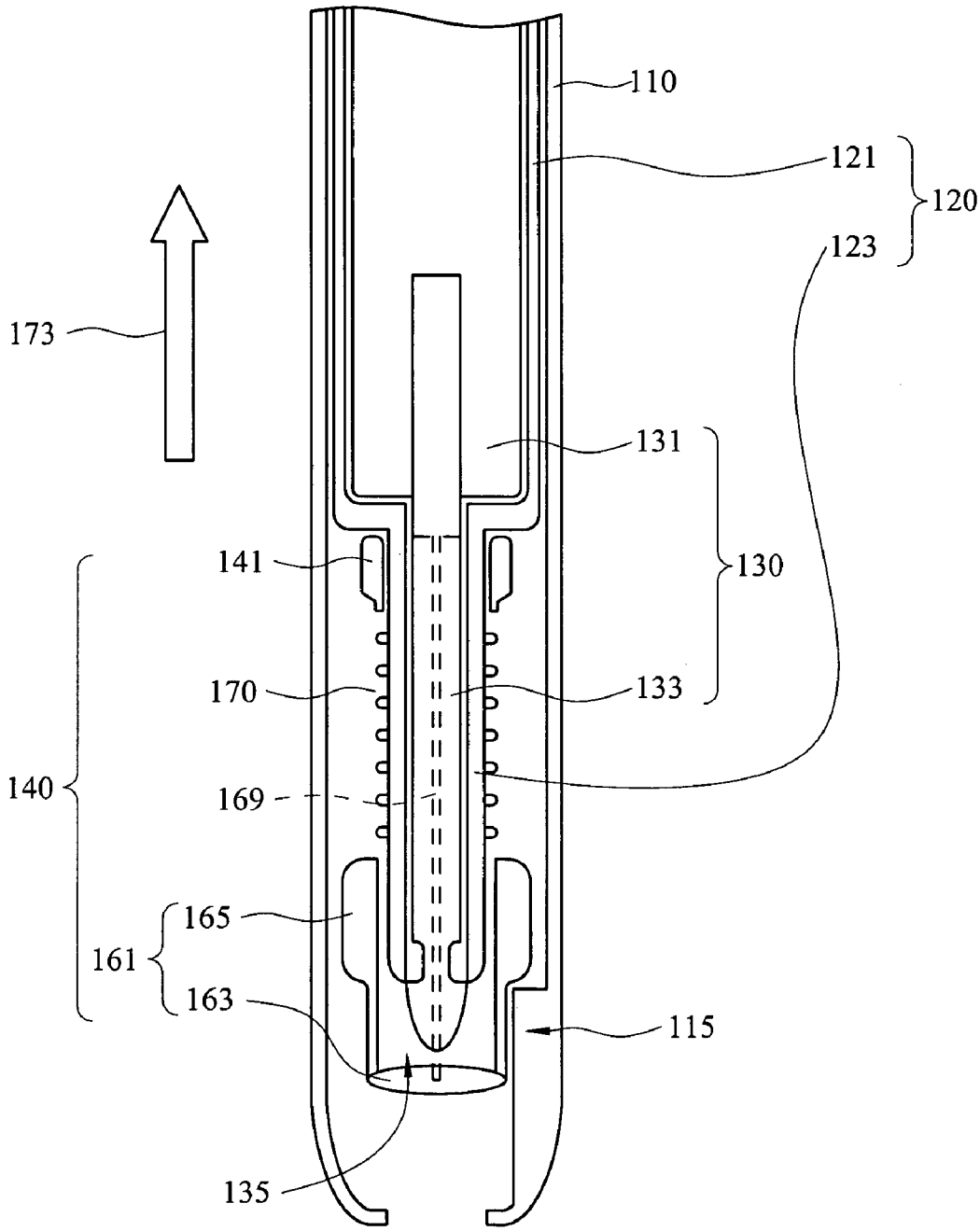
FIG. 3(B) (PRIOR ART)
FIG. 3(B) illustrates a closing action of a cover plate of an opening and closing device of a conventional capless retractable marker pen.
Figure 4:
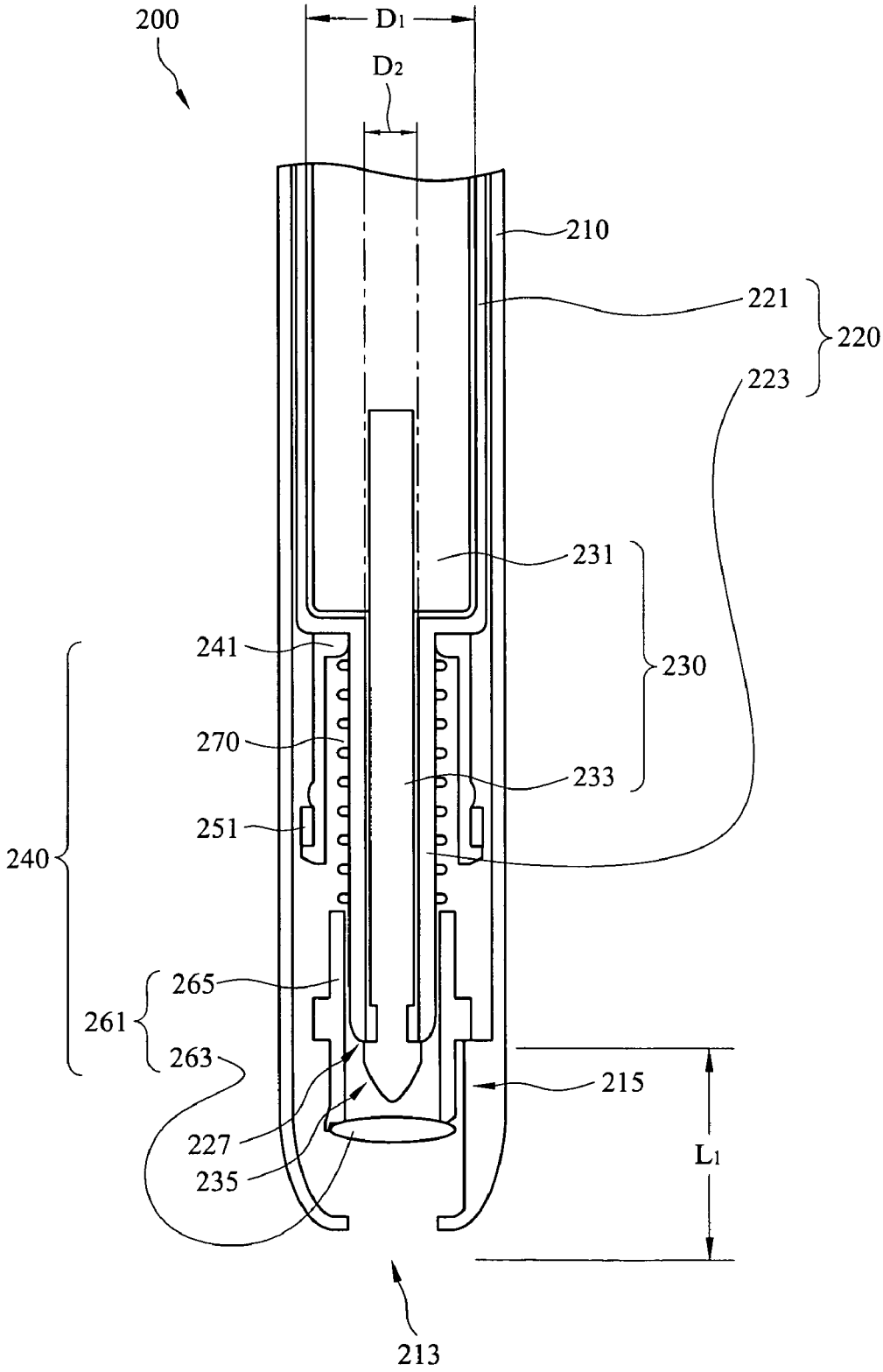
FIG. 4 illustrates a partial cross section showing a capless retractable marker pen in accordance with a preferred embodiment of the present invention.

FIG. 4 is a partial cross section showing a capless retractable marker pen in accordance with a preferred embodiment of the present invention. A capless retractable marker pen 200 of the present invention comprises a pen tube 210, a sheath 220, a writing member 230 and an opening and closing device 240. The pen tube 210 has an upper opening (not shown) and a lower opening 213, in which an arc protrusion 215 is set within the pen tube 210, is parallel to the lower opening 213, and is set apart from the lower opening 213 by a distance $L_1$. The sheath 220 is installed within the pen tube 210 and has an upper portion 221 and a lower portion 223, in which a diameter $D_1$ of the upper portion 221 is greater than a diameter $D_2$ of the lower portion 223. The top of the upper portion 221 is a closed end (not shown), and the bottom of the lower portion 223 is an open end 227. Typically, the writing member 230 is coaxially disposed within the sheath 220 and has an upper portion 231 and a lower portion 233. The upper portion 231 of the writing member 230 is disposed within the upper portion 221 of the sheath 220 and is composed of a liquid-absorbing wick for the storage of ink. The ink may be, for example, water-based ink, oil-based ink or organic-solvent-based ink, in which the organic-solvent-based ink may be, for example, alcohol-based ink. The lower portion 233 of the writing member 230 is disposed within the lower portion 223 of the sheath 220, in which a portion of the lower portion 233 extends into the upper portion 221. The writing member 230 is composed of a porous fibrous material. The lower portion 233 of the writing member 230 extends out of the open end 227 in the lower portion 223 of the sheath 220 to expose a writing tip 235. The ink is transported from the upper portion 231 to the writing tip 235 through the lower portion 233 by capillarity.

One feature of the capless retractable marker pen of the present invention is that it is based on a two-stage design for achieving the purpose of protracting and retracting a writing tip. As shown in FIG. 4, the opening and closing device 240 is coaxially disposed outside the lower portion 223 of the sheath 220, in which the opening and closing device 240 comprises a supporting device 241, a cover holder 251, a sealing member 261 and a spring member 270.

Figure 5:
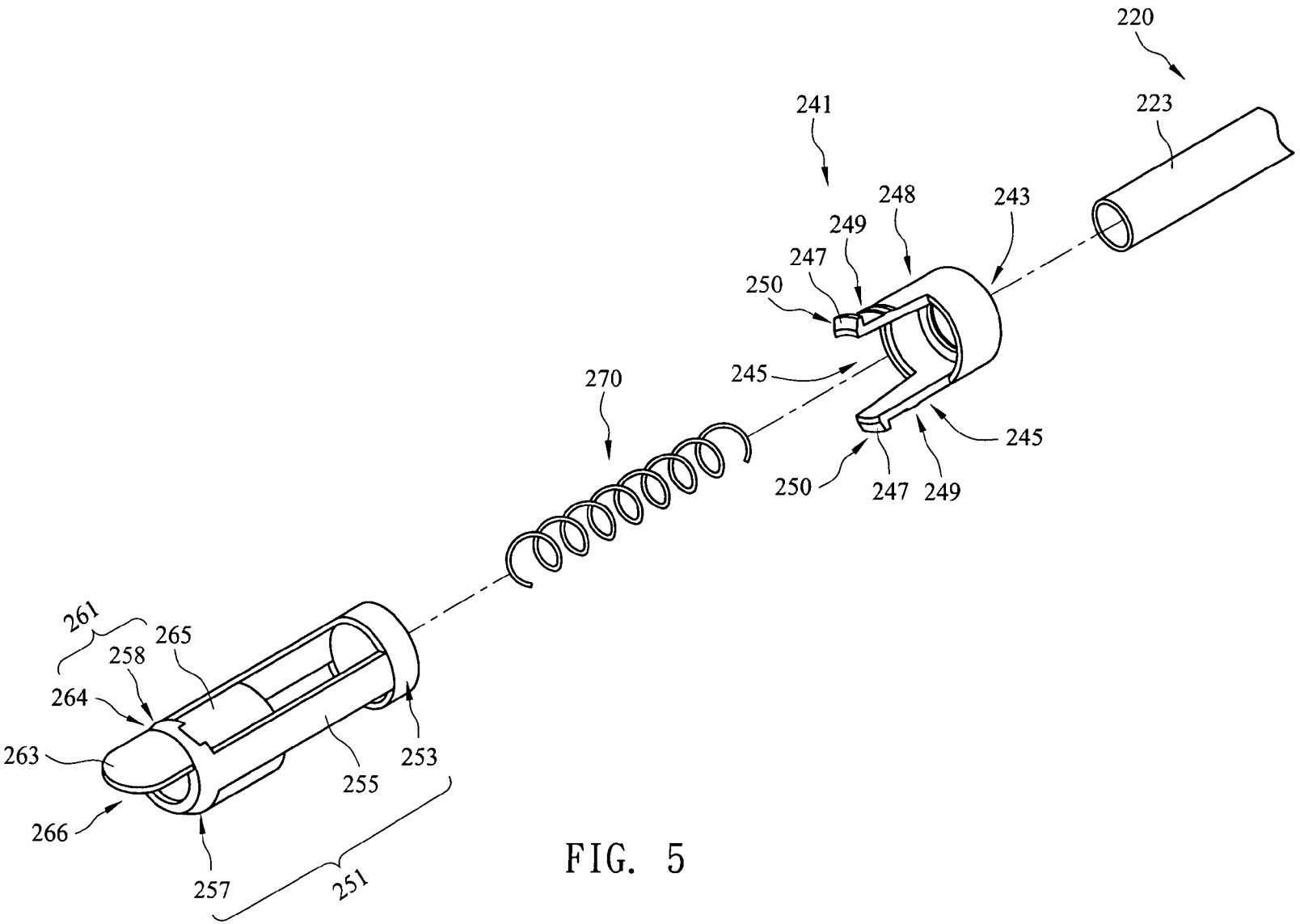
FIG. 5 illustrates a three-dimensional diagram of an opening and closing device in accordance with a preferred embodiment of the present invention.

FIG. 5 illustrates a three-dimensional diagram of an opening and closing device in accordance with a preferred embodiment of the present invention. In an embodiment, the supporting device 241 is coaxially disposed outside the lower portion 223 of the sheath 220, in which the supporting device 241 has an upper opening 243 and a lower opening 245. A plurality of hooks 247 are installed around the lower opening 245, in which an outer surface 248 of each hook 247 has a protrusion 249 in its substantially central portion. The cover holder 251 has an upper ring 253, a plurality of supports 255 connected to the upper ring 253, and a lower ring 257 connected to the supports 255, in which the upper ring 253 is coaxially disposed outside the supporting device 241 and clipped between a rear end 250 of each hook 247 and the protrusion 249. The sealing member 261 is coaxially clipped within the lower ring 257 of the cover holder 251 and covers the writing tip (not shown). The sealing member 261 includes a cover plate 263 and a cover supporting tube 265, and a side 264 of the cover plate 263 is movably deposed on a side 258 of the lower ring 257. The spring member 270 may be, for example, a spring or a member having an equivalent function, and is coaxially disposed outside the lower portion 223 of the sheath 220 and within the supporting device 241, in which the spring member 270 shores the supporting device 241 and the cover supporting tube 265 by elastic force, so as to make the cover plate 263 cover a lower surface 266 of the cover supporting tube 265 to seal the writing tip (not shown).

According to a preferred embodiment of the present invention, the supporting device 241 and the cover holder 251 may be composed of the same thermoplastic material or different thermoplastic materials. The thermoplastic material suitable for the supporting device 241 and the cover holder 251 typically includes but is not limited to polyformaldehyde (POM) and acrylonitrile butadiene styrene (ABS) copolymer.

Figure 6A:
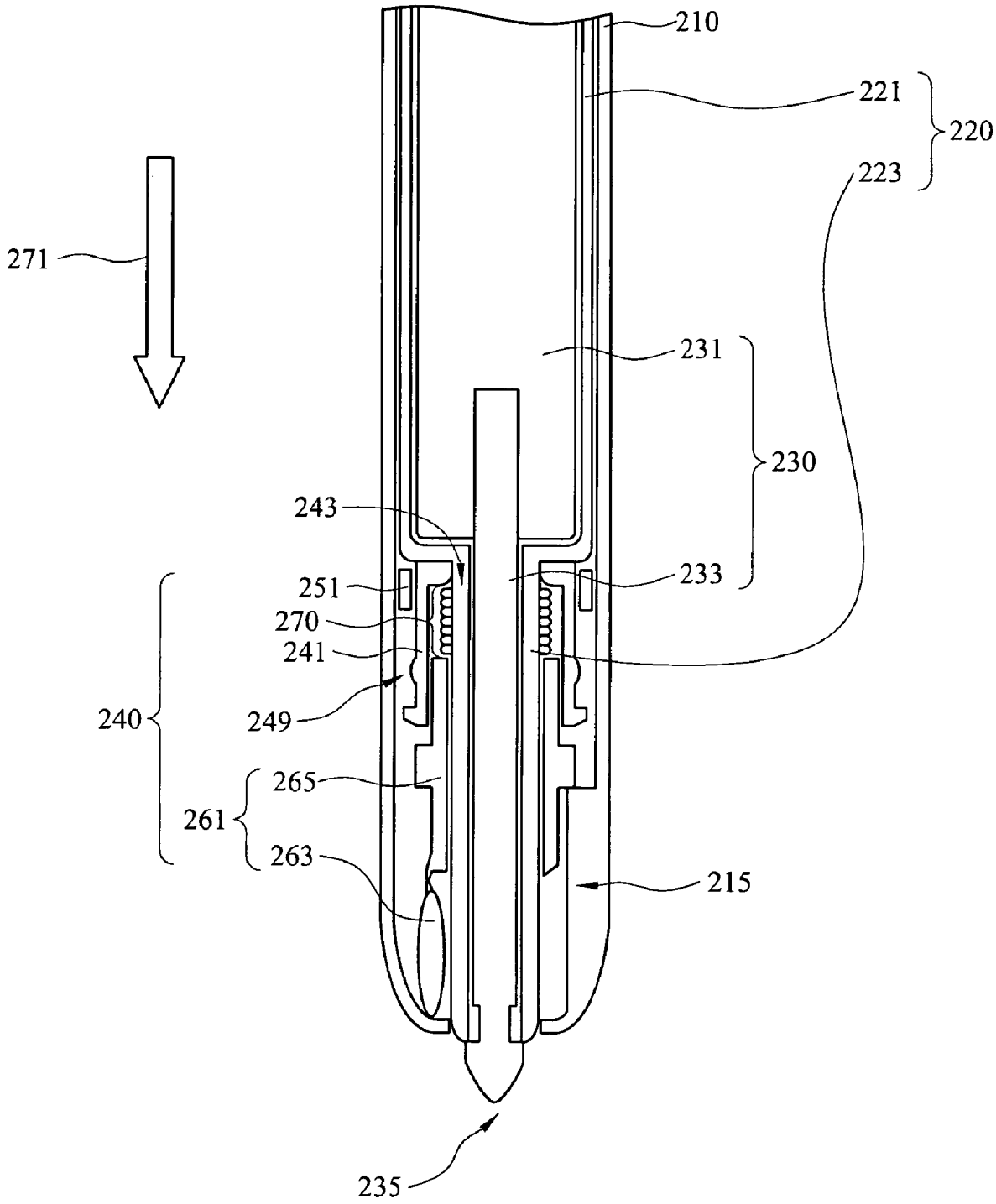
FIG. 6(A) illustrates an opening action of a cover plate of an opening and closing device of a capless retractable marker pen in accordance with a preferred embodiment of the present invention.

FIG. 6(A) illustrates an opening action of a cover plate of an opening and closing device of a capless retractable marker pen in accordance with a preferred embodiment of the present invention. When the sheath 220 and the writing tip 235 are moved downward by using an actuating means (not shown) installed on the top of the sheath 220 for example, the opening and closing device 240 descends to the arc protrusion 215 in the pen tube 210 along the direction shown by an arrow 271, and the cover holder 251 continuously rises along the direction shown by the arrow 271 across the protrusion 249 of the supporting device 241 to reach the outside of the upper opening 243 of the supporting device 241. With the rise of the cover holder 251, the cover plate 263 is opened to make the writing tip 235 project from the cover supporting tube 265 for writing.

Figure 6B:
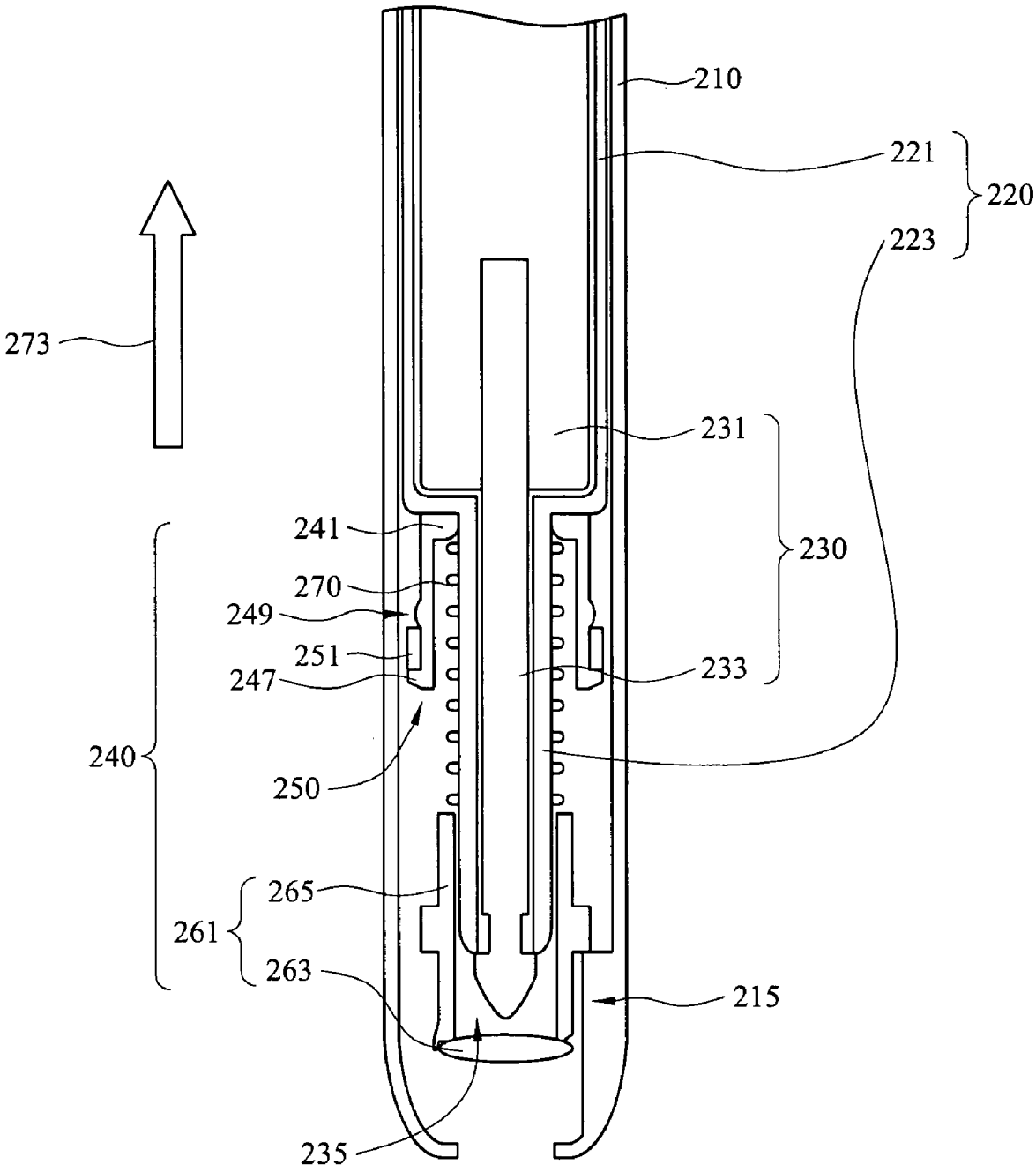
FIG. 6(B) illustrates a closing action of a cover plate of an opening and closing device of a capless retractable marker pen in accordance with a preferred embodiment of the present invention.

FIG. 6(B) illustrates a closing action of a cover plate of an opening and closing device of a capless retractable marker pen in accordance with a preferred embodiment of the present invention. After writing, the sheath 220 and the writing tip 235 are moved upward by using the actuating means (not shown), the supporting device 241 continuously rises along the direction shown by an arrow 273, and the cover holder 251 descends relatively across the protrusion 249 of the supporting device 241 to reach the rear end 250 of each hook 247 of the supporting device 241, so that a lower surface 268 of the cover supporting tube 265 is covered by the cover plate 263 to seal the writing tip 235. In brief, the opening and closing device for the capless retractable marker pen is based on a two-stage design, which combines the supporting device 241 and the cover holder 251, for achieving the purpose of protracting and retracting the writing tip.

It is worthy to note that the opening and closing device for the capless retractable marker pen can replace the conventional opening and closing device, which uses the plastic filament to control the cover plate. In the present invention, the opening and closing device is based on a two-stage design for achieving the purpose of protracting and retracting the writing tip. The opening and closing device for the capless retractable marker pen of the present invention is manufactured easily and assembled conveniently, so that the complicated assembly of the conventional opening and closing device can be effectively improved, and an automation process can be used to greatly increase the processing speed and yield.

According to the aforementioned embodiments of the present invention, one advantage of the application of the opening and closing device for the capless retractable marker pen of the present invention is that the opening and closing device is based on a two-stage design for achieving the purpose of protracting and retracting a writing tip. The opening and closing device for the capless retractable marker pen of the present invention enables easy manufacture and convenient assembly, so as to greatly increase the processing speed and yield.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structure.

What is claimed is:

1. An opening and closing device for a capless retractable marker pen, wherein the opening and closing device is disposed within a pen tube, and the opening and closing device comprises:

a supporting device having an upper opening and a lower opening, wherein a plurality of hooks are disposed around the lower opening, and a protrusion is disposed in a substantially central portion of an outer surface of each hook;

a cover holder having an upper ring, a plurality of supports connected to the upper ring and a lower ring connected to the supports, wherein the upper ring is coaxially disposed outside the supporting device and clipped between a rear end of each hook and each protrusion;

a sealing member coaxially clipped within the lower ring and covering a writing tip disposed in the supporting device and the cover holder, wherein the sealing member includes a cover plate and a cover supporting tube, and a side of the cover plate is movably disposed on a side of the lower ring; and a spring member coaxially disposed within the supporting device, wherein the spring member shores the supporting device and the cover supporting tube by elastic force, so as to make the cover plate cover a lower surface of the cover supporting tube to seal the writing tip, wherein when the writing tip moves downward, the opening and closing device descends to an arc protrusion in the pen tube, and the cover holder continuously rises across the protrusions of the supporting device to reach the outside of the upper opening of the supporting device, wherein with the rise of the cover holder, the cover plate is opened to make the writing tip project from the cover supporting tube.

2. The opening and closing device for a capless retractable marker pen according to claim 1, wherein a material of the supporting device is a thermoplastic plastic.

3. The opening and closing device for a capless retractable marker pen according to claim 1, wherein a material of the supporting device is selected from the group consisting of polyformaldehyde (POM) and acrylonitrile butadiene styrene (ABS) copolymer.

4. The opening and closing device for a capless retractable marker pen according to claim 1, wherein a material of the cover holder is selected from the group consisting of polyformaldehyde (POM) and acrylonitrile butadiene styrene (ABS) copolymer.

5. The opening and closing device for a capless retractable marker pen according to claim 1, wherein the supporting device and the cover holder are composed of the same material.

6. The opening and closing device for a capless retractable marker pen according to claim 1, wherein the supporting device and the cover holder are composed of different materials.

7. A capless retractable marker pen, comprising:

a pen tube having a first upper opening and a first lower opening, wherein an arc protrusion is set within the pen tube and is parallel to the first lower opening, and the arc protrusion is set apart from the first lower opening by a distance;

a sheath having a first upper portion and a first lower portion, wherein a diameter of the first upper portion is greater than a diameter of the first lower portion;

a writing member coaxially disposed within the sheath and having a second upper portion and a second lower portion, wherein the second upper portion is disposed within the first upper portion for storing ink, the second lower portion is disposed within the first lower portion to expose a writing tip, and a diameter of the second lower portion is smaller than a diameter of the second upper portion; and an opening and closing device coaxially disposed outside the first lower portion, and including:

a supporting device coaxially disposed outside the first lower portion of the sheath and having a second upper opening and a second lower opening, wherein a plurality of hooks are disposed around the second lower opening, and a protrusion is disposed in a substantially central portion of an outer surface of each hook;

a cover holder having an upper ring, a plurality of supports connected to the upper ring and a lower ring connected to the supports, wherein the upper ring is coaxially disposed outside the supporting device and clipped between a rear end of each hook and each protrusion;

a sealing member coaxially clipped within the lower ring and covering the writing tip, wherein the sealing member includes a cover plate and a cover supporting tube, and a side of the cover plate is movably disposed on a side of the lower ring; and a spring member coaxially disposed outside the first lower portion of the sheath and within the supporting device, wherein the spring member shores the supporting device and the cover supporting tube by elastic force, so as to make the cover plate cover a lower surface of the cover supporting tube to seal the writing tip, wherein when the sheath moves downward, the opening and closing device descends to the arc protrusion in the pen tube, and the cover holder continuously rises across the protrusions of the supporting device to reach the outside of the second upper opening of the supporting device, wherein with the rise of the cover holder, the cover plate is opened to make the writing tip project from the cover supporting tube.

8. The capless retractable marker pen according to claim 7, wherein the ink is selected from the group consisting of water-based ink and oil-based ink.

9. The capless retractable marker pen according to claim 7, wherein a material of the supporting device is a thermoplastic plastic.

10. The capless retractable marker pen according to claim 7, wherein a material of the supporting device is selected from the group consisting of polyformaldehyde (POM) and acrylonitrile butadiene styrene (ABS) copolymer.

11. The capless retractable marker pen according to claim 7, wherein a material of the cover holder is selected from the group consisting of polyformaldehyde (POM) and acrylonitrile butadiene styrene (ABS) copolymer.

12. The capless retractable marker pen according to claim 7, wherein the supporting device and the cover holder are composed of the same material.

13. The capless retractable marker pen according to claim 7, wherein the supporting device and the cover holder are composed of different materials.

* * * * *